US005326107A

United States Patent [19]

Park

[11] Patent Number: 5,326,107

[45] Date of Patent: Jul. 5, 1994

[54] APPARATUS FOR BALL PLACEMENT ON A GOLF TEE

[75] Inventor: Hyo C. Park, Belle Mead, N.J.

[73] Assignee: Forty Four International, Inc., Belle Mead, N.J.

[21] Appl. No.: 65,665

[22] Filed: May 21, 1993

[51] Int. Cl.[5] ..... A63B 57/00

[52] U.S. Cl. ..... 273/201

[58] Field of Search ..... 273/201

[56] References Cited

U.S. PATENT DOCUMENTS

| | | | |
|---|---|---|---|
| 1,940,321 | 12/1933 | Pagett | 273/201 |
| 2,212,877 | 8/1940 | Gale | 273/201 |
| 3,003,770 | 10/1961 | Jones | 273/201 |
| 3,756,606 | 9/1973 | Land | 273/201 |
| 4,146,232 | 3/1979 | Stone | 273/201 |
| 4,360,204 | 11/1982 | Karr . | |
| 4,441,717 | 4/1984 | Willcox | 273/201 |
| 4,676,397 | 6/1987 | Hoffmeister . | |
| 4,732,391 | 3/1988 | Karr . | |
| 4,741,537 | 5/1988 | Adam . | |
| 4,796,893 | 1/1989 | Choi . | |
| 4,817,955 | 4/1989 | Hickson et al. . | |
| 4,934,697 | 6/1990 | Shiau Ruey J. . | |
| 5,096,200 | 3/1992 | Komori et al. | 273/201 |

FOREIGN PATENT DOCUMENTS

| | | | |
|---|---|---|---|
| 1501563 | 11/1967 | France | 273/201 |
| 2180762 | 4/1987 | United Kingdom | 273/201 |

*Primary Examiner*—William E. Stoll

*Attorney, Agent, or Firm*—Mathews, Woodbridge & Collins

[57] ABSTRACT

The invention relates to a golf ball storage and dispensing apparatus including a horizontally movable arm member. A housing covers the arm member in a retracted position and stores the golf balls above the arm member. A guide wire supports a golf ball during movement of the arm member from the housing towards the tee. When the arm member is in a fully extended position, the arm member moves over the guide wire for releasing the ball onto the tee.

8 Claims, 9 Drawing Sheets

APPARATUS FOR BALL PLACEMENT ON A GOLF TEE

BACKGROUND OF THE INVENTION

1. Field of the Invention

This invention relates to a golf ball storage and dispensing apparatus having a utilitarian structure which is inexpensive to manufacture.

2. Description of the Prior Art

Golfers at typical driving ranges are required to tee-up balls manually after every shot. There have been numerous attempts in the prior art for providing automatic or mechanically assisted golf ball teeing devices.

U.S. Pat. No. 4,741,537 to Adam describes an apparatus for semi-automatically teeing up golf balls. A cylinder including flexible tubing formed as a helix is used for storing the golf balls. A rocking bar delivers one ball at a time to a pneumatically actuated tee. The tee reciprocates through an orifice in a hitting mat under low positive air pressure for lifting the ball to a preselected height. Upon hitting the golf ball from the tee, the tee drops down through the mat orifice to receive another ball. This pneumatic system is cumbersome to install and requires modification of the hitting mat.

U.S. Pat. No. 4,732,391 to Karr describes a golf ball storage and dispenser apparatus including an arm mechanism pivotable about a support shaft between a vertical position and a horizontal position. A gear train mechanism having a series of interacting toothed gear wheels operates intermediate of the arm mechanism and a motor. A reciprocating rod is positioned between the arm mechanism and a rotor of the gear train mechanism for causing the arm to move between the vertical and horizontal positions. A delay switch retains the arm mechanism in the horizontal position for a sufficiently long period of time in order to enable the golf ball to roll down the entire length of the arm mechanism and be deposited on a tee. The Karr device is electrically and structurally complicated resulting in high manufacturing costs.

U.S. Pat. No. 4,817,955 to Hickson et al. describe a coin operated golf ball dispenser and tee apparatus. Golf balls are discharged one at a time to an inclined tube by a first drive motor. A gripper is mounted on a slide for gripping a ball when activated by a switch. The gripper includes a first suction cup fixedly mounted to the slide and a secured movable suction cup actuated by a solenoid. A second motor moves the slide and attached gripper outwardly to a position above the tee. A pair of switches are closed upon movement of the gripper to de-energize the solenoid causing release of the ball. The second motor is reversed to return the slide to a retracted position. The Hickson et al. device is complicated in terms of structure and operation.

Of possible general relevance are U.S. Pat. Nos. 4,360,204 to .Karr, 4,441,717 to Wilcox, 4,676,307 to Hoffmeister, 4,796,893 to Choi and 4,934,697 to Shiau Ruey.

It is desirable to provide a golf dispenser and storage apparatus which is relatively simple and has low manufacturing costs.

SUMMARY OF THE INVENTION

Briefly described, the present invention comprises an apparatus and method for dispensing golf balls one at a time to a golf tee. A horizontally movable arm mechanism is movable between a housing and a golf tee. A plurality of golf balls are held in the housing and are deposited one at a time to the arm mechanism. The arm mechanism includes an arm member with a slidable guide wire positioned therein. The guide wire extends from the arm member for supporting the golf ball when the arm member moves from the housing to the tee. When the arm is in a fully extended position from the housing, the arm member covers the guide wire for releasing the supported golf ball to the tee. After depositing the golf ball on the tee, the arm is retracted into the housing.

An inclined ramp is included in the housing for receiving balls and depositing the balls on the guide wire. A switch is attached to the arm member and a pair of contact relays are positioned in the housing. The switch contacts the first relay to actuate the motor in a forward direction and contacts the second relay to actuate the motor in the reverse direction, thereby moving the arm toward or away from the tee.

The invention will be more fully described with reference to the following drawings.

DETAILED DESCRIPTION OF THE INVENTION

During the course of this description like numbers will be used to identify like elements according to the different figures which illustrate the invention.

Figure 1:
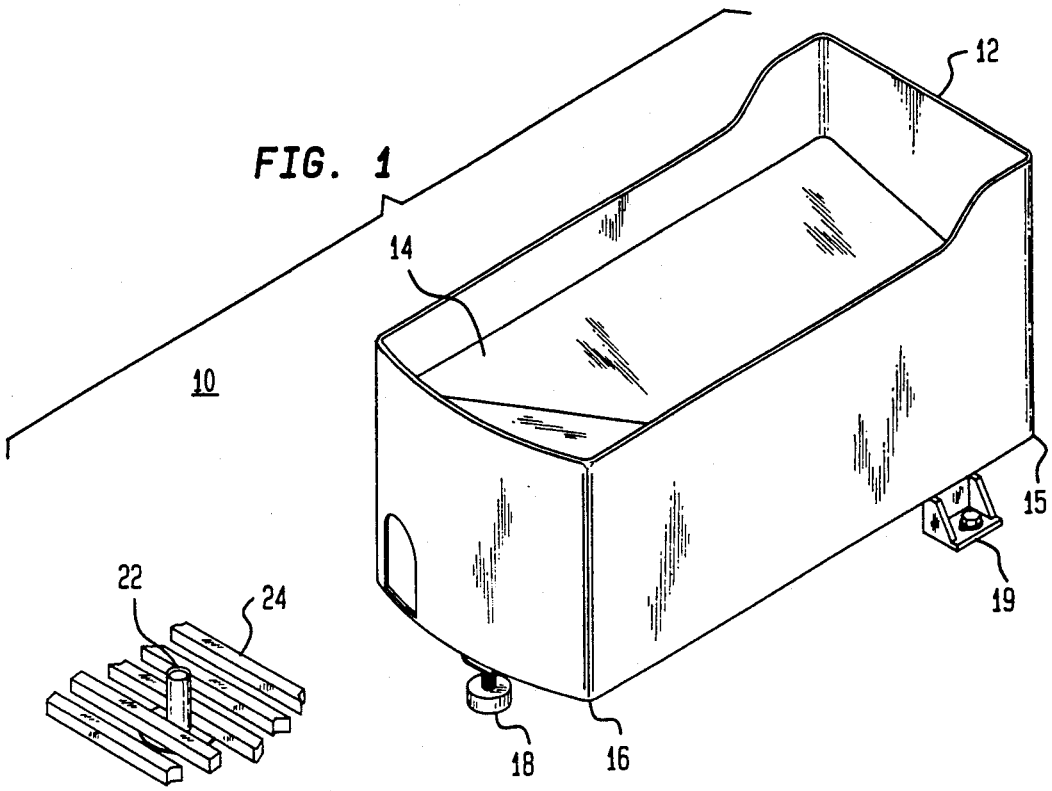
FIG. 1 is a perspective view of the golf ball dispensing apparatus of the present invention in a retracted position.

FIG. 1 is a perspective view of golf ball dispensing apparatus 10 in accordance with the principals of the present invention. Housing 12 includes a recessed ball receiving tray 14. Rear end 15 of housing 12 is supported by rear leg 19 and front end 16 of housing 12 is supported by front leg 18. Preferably, front leg 18 is adjustable in a vertical direction for raising or lowering golf ball dispensing apparatus 10 in relation to golf tee 22. Typically, mat 24 supports golf tee 22 at typical golf driving ranges. In the alternative, a standard golf tee can be inserted directly into the ground.

Figure 2:
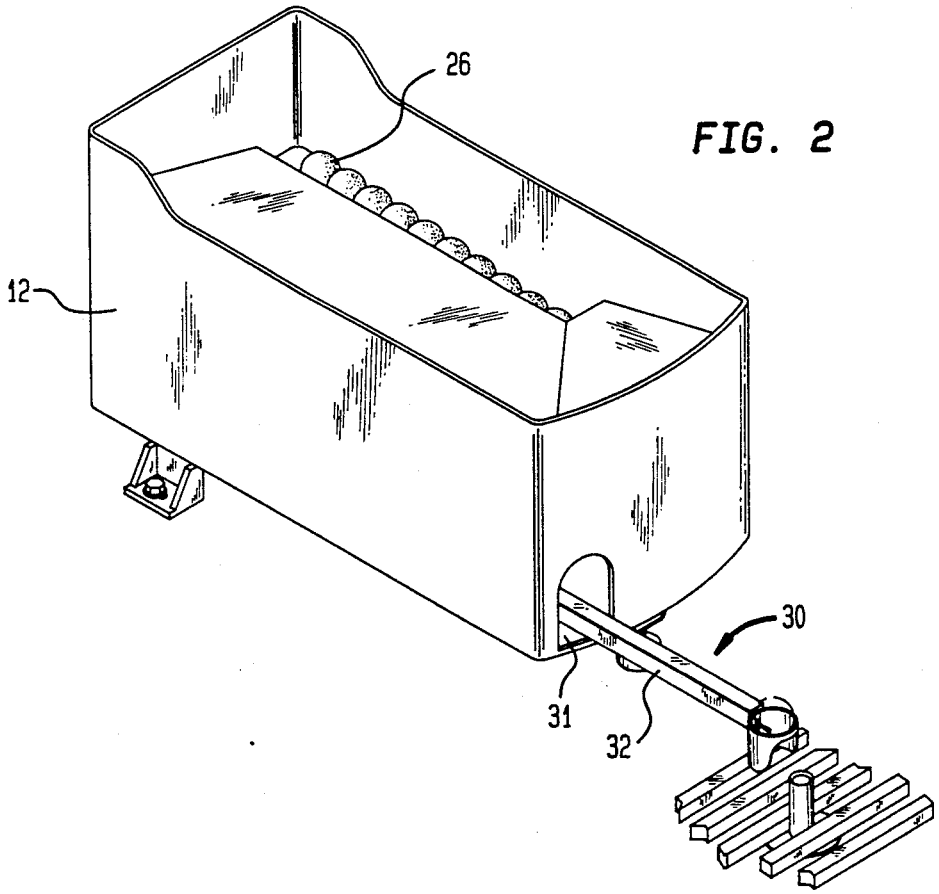
FIG. 2 is a perspective view of the golf ball dispensing apparatus in an extended position.

Balls 26 are received in ball receiving tray 14, as shown in FIG. 2. Arm mechanism 30 dispenses balls 26 from housing 12 to tee 22. During dispensing of ball 26 from housing 12 towards tee 22, arm member 32 extends from opening 31 in housing 12.

Figure 3A:
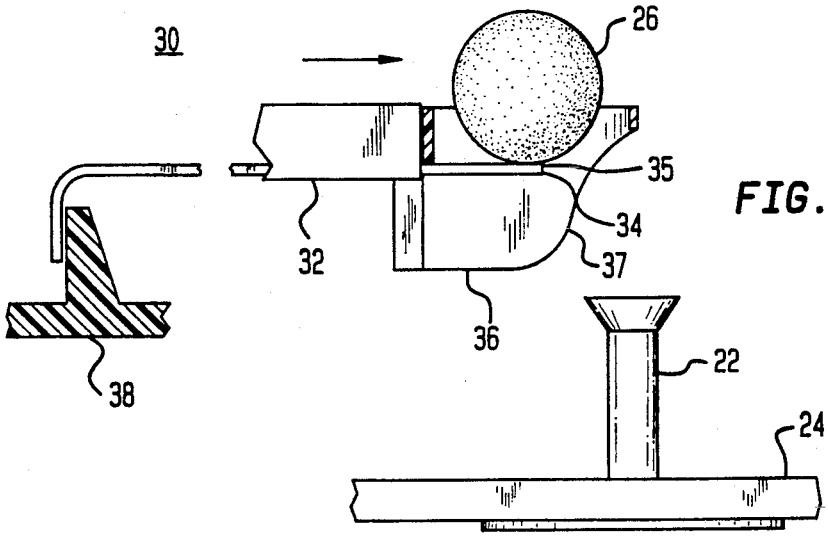
FIG. 3A is a side elevational view of the golf ball dispensing device including an arm support member for supporting the ball.

FIG. 3A is a side elevational view of golf ball dispensing apparatus 10 including ball 26 supported on arm mechanism 30. Ball 26 is supported on guide wire 34. Guide wire 34 is movable within arm member 32. End 35 of guide wire 34 protrudes from end 33 of arm member 32 for supporting ball 26 during movement of arm member 32 from housing 12 towards tee 22. Guide Wire 34 is prevented from moving forward by stop member 38.

Figure 3B:
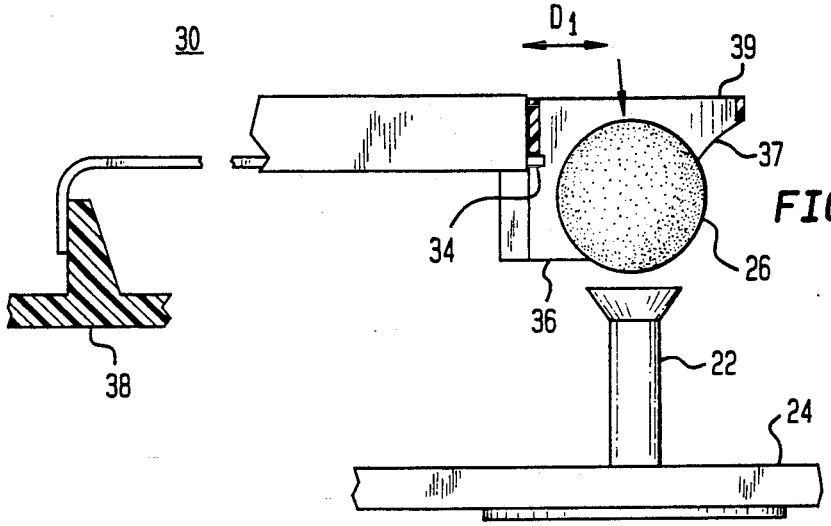
FIG. 3B is a side elevational view of the golf ball dispensing device after extension of the arm towards the golf tee.

FIG. 3B illustrates arm mechanism 30 in a fully extended position. Arm member 32 moves to a predetermined distance $D_1$ from tee 22. Arm member 32 moves over end 35 of guide wire 34 for releasing ball 26 from guide wire 34. Ball 26 is guided by guide member 36 onto tee 22. Preferably, guide member 36 has a cylindrical shape with an indentation 37 on either side for allowing guide member 36 to be positioned over tee 22. Ring 39 is positioned at the upper portion of guide member 36.

Figure 3C:
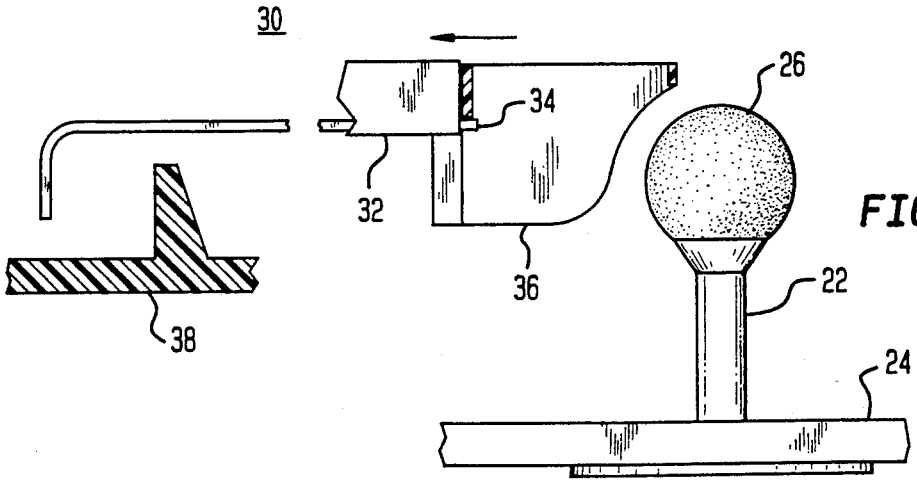
FIG. 3C is a side elevational view of the golf ball dispensing device after placement of the golf ball on the golf tee.

FIG. 3C illustrates arm mechanism 30 after ball 26 is placed on tee 22. Guide wire 34 and arm member 32 are retracted towards housing 12 away from tee 22 for receipt of the next ball.

Figure 4:
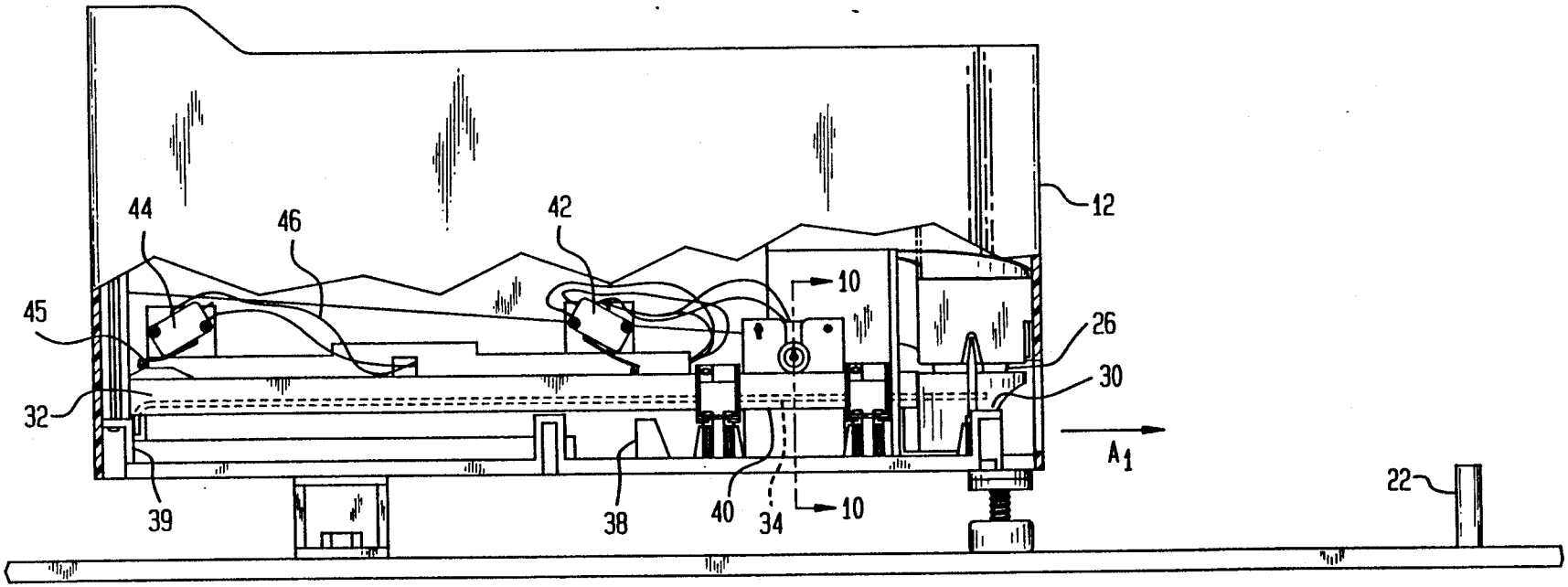
FIG. 4 is a vertical cross-sectional view of the golf ball dispensing apparatus shown in FIG. 1.

FIG. 4 illustrates arm mechanism 30 in the retracted position. Arm mechanism 30 is positioned within housing 12. Guide wire 34 is stopped from movement into housing 12 by stop member 39. Arm member 32 slides over guide wire 34 for enabling guide wire 34 to protrude from arm member 34 for receipt of the next ball. Preferably, housing 12 is formed of durable plastic.

Motor 40 is operated for moving arm mechanism 30 towards or away from tee 22. Motor 40 is connected to a power source (not shown). A foot pedal as disclosed in U.S. Pat. No. 4,360,204 can be used for switching on and off the power source. Arm mechanism 30 includes switch 45 which contacts relay 44 when arm mechanism 30 is in the retracted position. Leads 46 contact motor 40 for advancing arm member 32 in direction $A_1$ towards tee 22.

Figure 5:
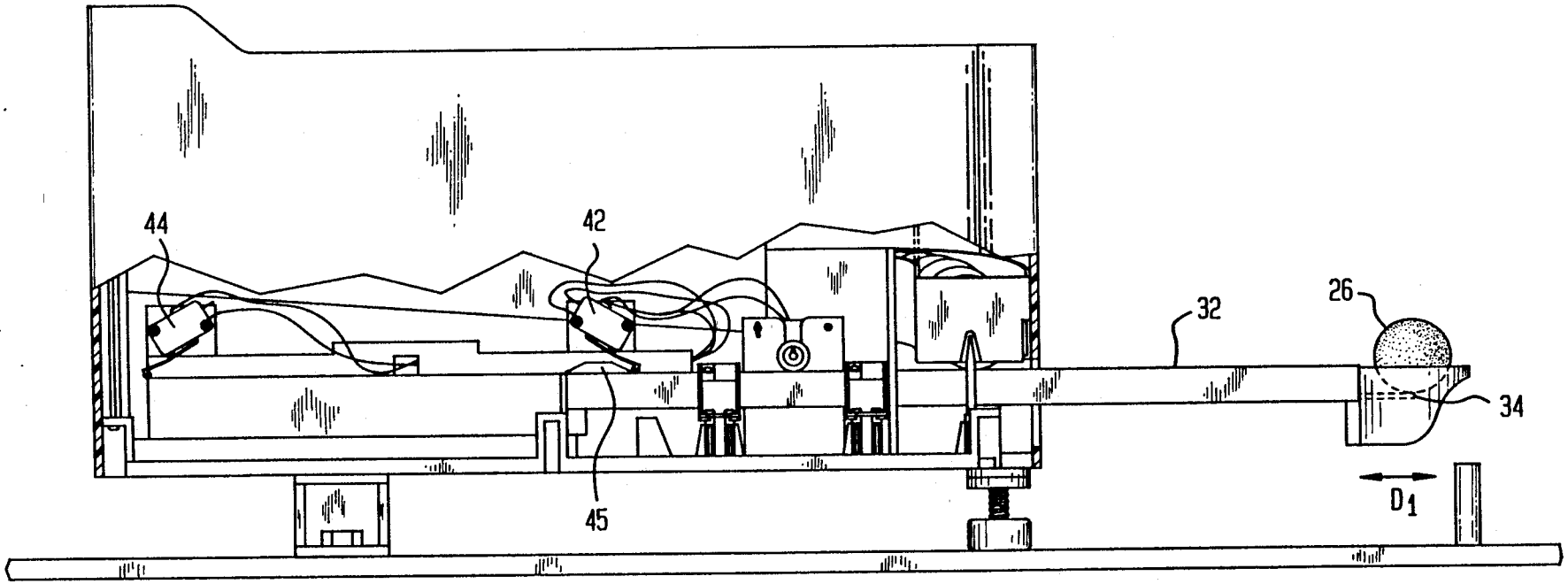
FIG. 5 is a vertical cross-sectional view of the golf ball dispensing apparatus shown in FIG. 2.

FIG. 5 illustrates arm member 32 moving ball 26 towards tee 22. Motor 40 is activated until arm member 32 is extended to distance $D_1$ from tee 22. Switch 45 is positioned adjacent relay 42. The extension of arm member 32 towards the tee prevents the next ball 26 from rolling onto guide member 34, thereby enabling balls 26 to be dispensed one at a time.

Figure 6:
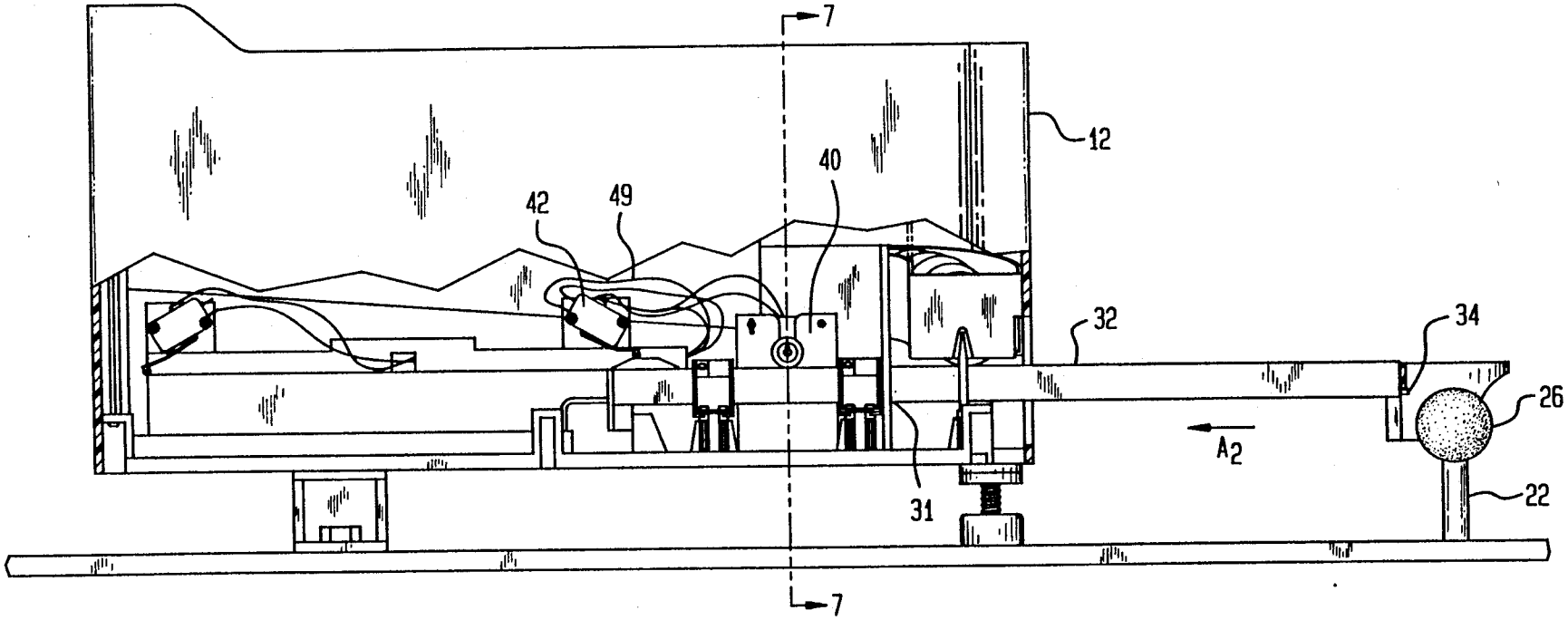
FIG. 6 is a vertical cross-sectional view of the golf ball teeing apparatus after placement of the golf ball on the golf tee.

FIG. 6 illustrates arm 32 in a fully extended position. Switch 45 contacts relay 42. Leads 49 connect relay 42 to motor 40. Relay 42 reverses the direction of motor 40 in order to retract arm member 32 in direction $A_2$ into housing 16 after placement of ball 26 on tee 22.

Figure 7:
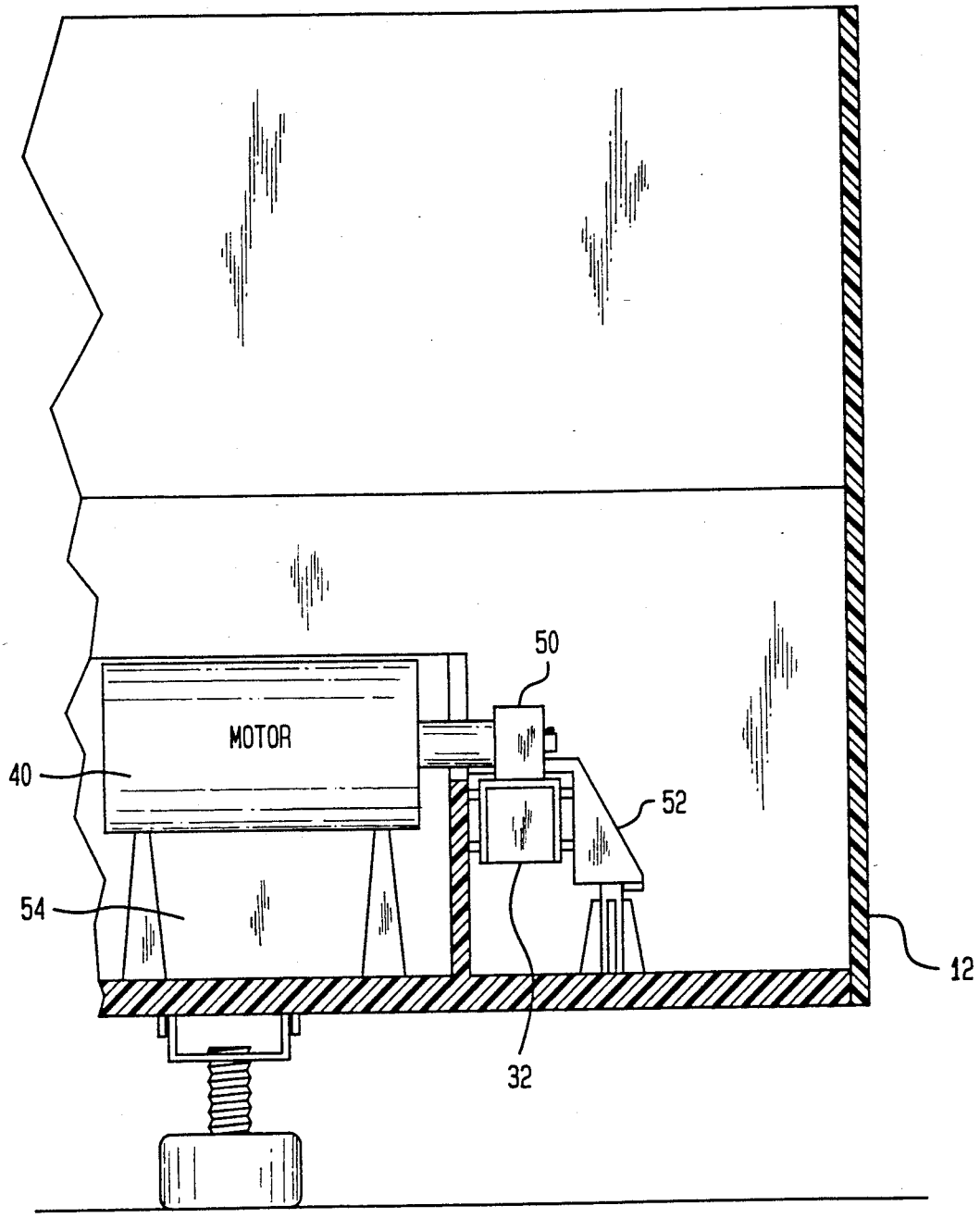
FIG. 7 is a horizontal cross-sectional view of the golf ball teeing apparatus including the motor.

Rotor 50 is attached to arm member 32 for moving arm member 32 in the forward or reverse directions upon activation of motor 40, as shown in FIG. 7. Motor 40 is attached to housing 12 with leg 52 and base 54.

Figure 8:
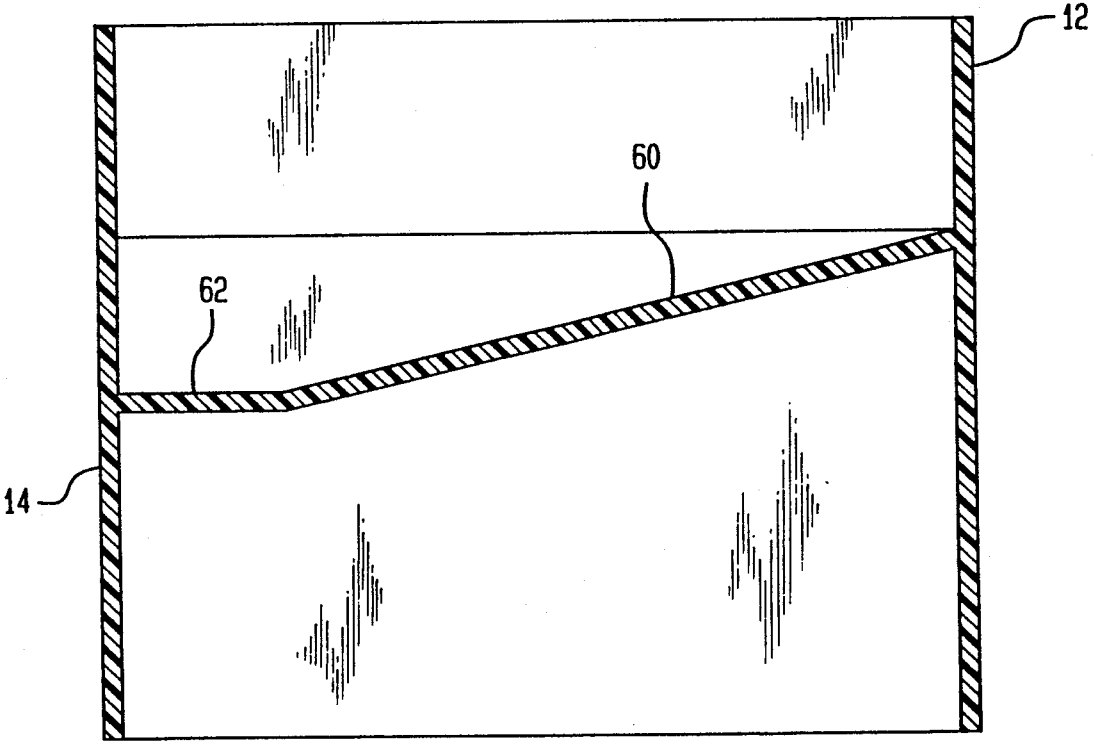
FIG. 8 is a horizontal cross-sectional view of the ball receiving tray of the present invention.

FIG. 8 is a cross-sectional view of ball receiving tray 14. Portion 60 of ball receiving tray 14 is angled downwardly towards ramp 62. Ramp 62 guides balls 26 towards arm mechanism 30.

Figure 9:
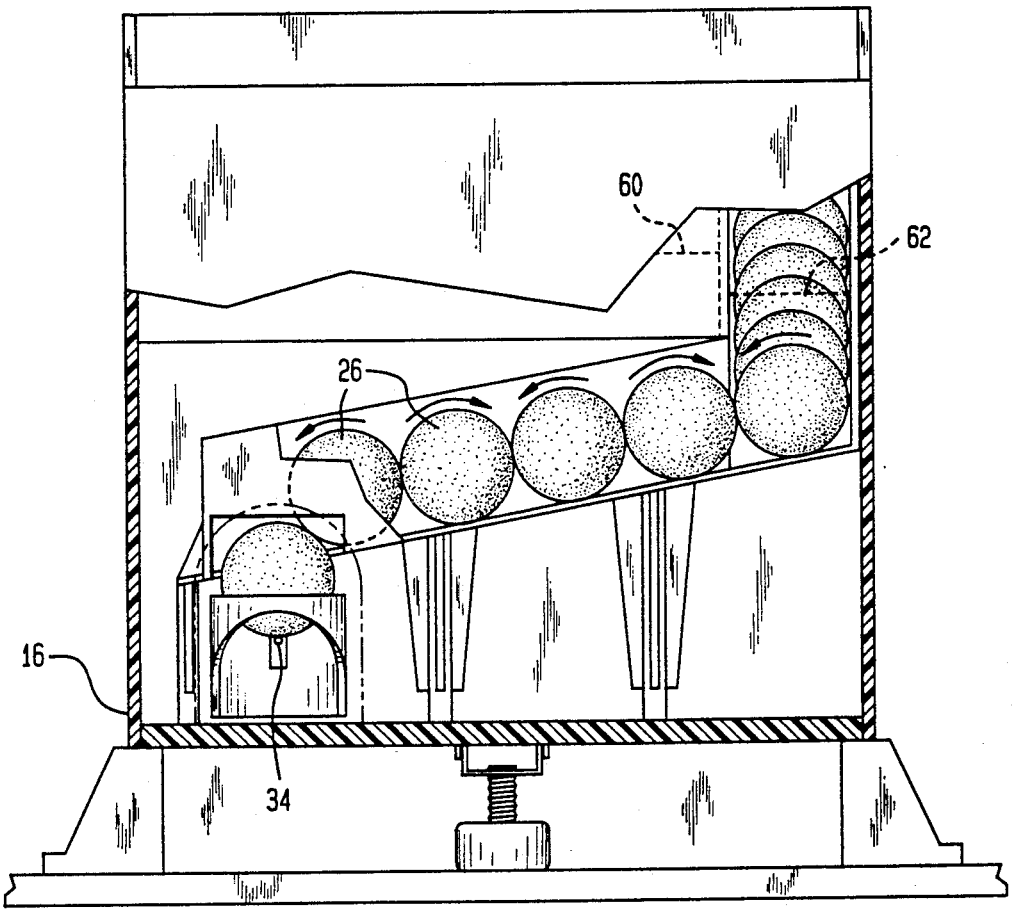
FIG. 9 is a vertical cross-sectional view of the ball feeding ramp including stored golf balls.
Figure 10:
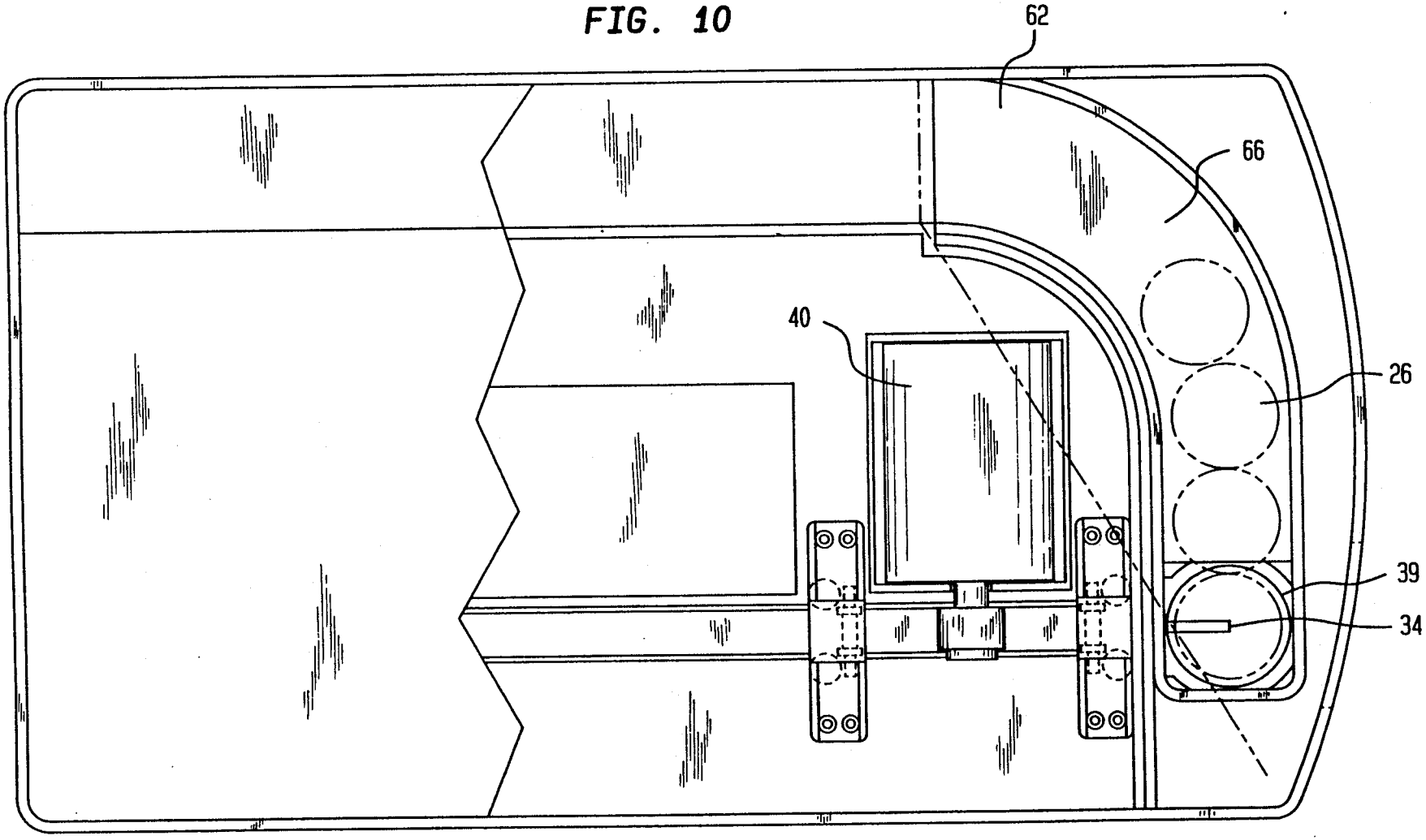
FIG. 10 is a top plan view of the ball feeding ramp of the present invention.

FIGS. 9 and 10 illustrate placement of balls 26 on guide wire 34. Ramp 62 includes curved portion 66. Balls roll single file down portion 60 of ball receiving tray 14 to ramp 62. Adjacent balls rotate in opposite directions for preventing jamming of balls 26 in ramp 62. Ball 26 is received within ring 39 and is supported on guide member 34.

The present invention is a mechanically uncomplicated golf ball dispenser. A horizontal arm including a means for supporting the golf ball extends from a housing for placement of balls on a tee. The means for supporting the golf ball automatically releases the ball onto the tee. The arm is stored within the housing when the dispenser is not in use. The present invention has the advantage of being inexpensive to manufacture.

While the invention has been described with reference to the preferred embodiment thereof, it will be appreciated by those of ordinary skill in the art that modifications can be made to the structure and form of the invention without departing from the spirit and scope thereof.

I claim:

1. A golf ball dispenser for dispensing golf balls one at a time to a golf tee comprising:

a housing for holding a plurality of golf balls; and a horizontally movable arm member, said arm member movable between a first position within said housing and a second position above a tee said first position and said second position having a equal vertical height, said arm member including a guide wire for supporting a golf ball at a first end of said arm member;

wherein said arm member releases a supported golf ball when said movable arm member is moved to said second position.

2. The apparatus of claim 10 wherein said arm member is hollow and said guide wire is positioned with said arm, said guide wire extending from said arm when said arm is in said first position for supporting a ball and said arm slidably moving over said guide wire when said arm is in said second position.

3. The apparatus of claim 2 further comprising:

ball guiding means positioned at said first end of said arm member for guiding a ball onto a tee when said arm is in said second position.

4. The apparatus of claim 3 wherein said ball guiding means includes a cylinder having a side opening for receiving a tee.

5. The apparatus of claim 4 wherein said housing has an upper and lower portion and a ball receiving tray positioned at said upper portion.

6. The apparatus for claim 5 further comprising:

a ramp housing positioned within said housing for receiving balls, said ramp having a first and second end, said first end connected to said ball receiving tray and said second end of said ramp positioned adjacent said arm member.

7. The apparatus of claim 6 further comprising:

motor means for moving said arm between said first and second position.

8. The apparatus of claim 7 further comprising:

a first and second switch positioned on said arm member, said first switch actuating said motor in a forward direction and said second switch actuating said motor in a reverse direction.

* * * * *